United States Patent [19]

Bay

[11] 4,445,679

[45] May 1, 1984

[54] APPARATUS FOR TRANSPORTING SINGLE SHEETS OF DIFFERENT RECTANGULAR FORMATS

[76] Inventor: Otto Bay, Luzernstrasse 45, CH-4553 Subingen, Switzerland

[21] Appl. No.: 332,305

[22] Filed: Dec. 18, 1981

[30] Foreign Application Priority Data

Dec. 20, 1980 [DE] Fed. Rep. of Germany ..... 3048298

[51] Int. Cl.[3] ..... B65G 47/24; B65H 7/10; B65H 9/08

[52] U.S. Cl. ..... 271/227; 271/184; 271/225; 271/250; 271/265; 198/394

[58] Field of Search ..... 271/184, 185, 227, 228, 271/229, 232, 225, 249, 250, 252, 265; 198/394, 395, 401

[56] References Cited

U.S. PATENT DOCUMENTS

| | | | |
|---|---|---|---|
| 2,243,557 | 5/1941 | Finster | 271/225 |
| 2,712,936 | 7/1955 | Backhouse | 271/252 |
| 3,521,880 | 7/1970 | Shebanow et al. | 271/227 |
| 4,155,440 | 5/1979 | Bogdanski et al. | 271/185 |
| 4,192,495 | 3/1980 | Heinzelmann et al. | 271/185 |

FOREIGN PATENT DOCUMENTS

| | | |
|---|---|---|
| 1289487 | 2/1969 | Fed. Rep. of Germany . |
| 1296573 | 5/1969 | Fed. Rep. of Germany . |
| 2829221 | 1/1979 | Fed. Rep. of Germany . |

*Primary Examiner*—Bruce H. Stoner, Jr.
*Assistant Examiner*—James E. Barlow
*Attorney, Agent, or Firm*—Spencer & Frank

[57] ABSTRACT

Apparatus for transporting single flexible sheets having different rectangular formats in succession to an automatic device for further processing. The apparatus includes: a flat sheet-advancement path for transporting the sheets in a transporting direction to the automatic device; a sheet advancing mechanism for advancing each sheet in a straight line on the path in the transporting direction; a switchable rotation-inducing mechanism switchable into active position in which it grips the sheet to form a stationary axis of rotation for the sheet at a selected location along the path; and a plurality of sensors spaced apart along the path and connected to the rotation-inducing mechanism for sensing each sheet being transported along the path, recognizing at least one selected sheet format and switching the rotation-inducing mechanism into its active position in response to recognition of the at least one selected format, the sheet advancing mechanism being constructed to permit slippage of a sheet at the selected location for permitting such rotation to occur.

12 Claims, 6 Drawing Figures

APPARATUS FOR TRANSPORTING SINGLE SHEETS OF DIFFERENT RECTANGULAR FORMATS

BACKGROUND OF THE INVENTION

The present invention relates to an apparatus for transporting single sheets of paper, plastic foil or the like of varying rectangular format, in particular from an automatic microfilm printer or copying machine to an automatic device for perforating the binding edge of each sheet and, as needed, folding the sheets. Such apparatus has: a flat sheet-advancement track on which are disposed transporting means for the single sheets, which act in a straight line; accessory means capable of being switched on and off for selectively rotating a single sheet being advanced and acting upon the single sheets when in their "on" state; and sensors, actuatable by each single sheet as it is transported, for recognizing the format of that sheet. Upon recognition of one sheet format, the sensors trigger the switching on of the accessory means.

Especially in industrial concerns, construction drawings and large-sized plans and the like are put onto microfilm. Microfilming makes it possible both to save space in library storage and to produce microfilm prints economically as needed, in various sheet formats and in the number of copies required for the operating divisions of the concern, such as workshops, purchase and storage of materials, cost assessment, bidding and so forth. The same applies to modern copying machines, with which copies of various formats can be made from one original, whether in the form of enlargements or in the form of reductions. In the following description, reference will be made only to apparatus for making prints from microfilm, without the invention being restricted to such an application.

Depending on how the automatic re-enlargement apparatus is programmed, this apparatus continuously provides the re-enlargements, produced in various rectangular formats from microfilm, to some desired, further automatic processing means. For instance, single sheets of large size are folded in accordion or zig-zag fashion down to A 4 (DIN) format as required for collating in file boxes, with an additional crosswise fold being effected if required. However, these re-enlargements must arrive at the intended automatic further processing apparatus with the correct edge—that is, the edge intended for a list of pieces to be worked or a designated plan—forward, so that the perforation of the binding edge mentioned above will be effected, possibly with reinforcements for the edges of the perforations, at this forward edge of the sheet. Following the folding of the sheet which may occur, the list or plan will then be located on the topmost part of the folded sheet in a stack and in any case on a corner of the sheet located away from the binding edge.

In contrast to single sheets to be folded into formats A 0 to A 3, where the binding-edge perforation is to be effected on the narrow edge of the sheet remote from the workpiece list, a sheet of A 4 format does not require folding; however, in this case the binding-edge perforation must be effected on its longer edge, remote from the workpiece list, so that for this reason the single sheet must arrive at the automatic apparatus referred to above with this longer edge forward.

SUMMARY OF THE INVENTION

Based on an apparatus of the type described at the outset above, it is thus an object of the present invention to permit single sheets of varying rectangular format arriving one after another, particularly from an automatic microfilm printer, to be transported further to an automatic device for further processing, such as one for effecting the binding-edge perforation, in such a manner that all these different single sheets arrive at the further processing apparatus with the edge of the sheet that is correct for the particular intended further processing at the front. This object applies not only to the DIN A 4 format referred to above by way of example; it can apply equally well to some other sheet format, depending upon the particular structural embodiment of a microfilm printer that is being used at that time.

The above and other objects are achieved according to the invention by the provision of novel apparatus for transporting single flexible sheets having different rectangular formats in succession to an automatic device for further processing, which apparatus includes:

means defining a flat sheet-advancement path for transporting the sheets in a transporting direction to the automatic device;

sheet advancing means associated with the path for advancing each sheet in a straight line on the path in the transporting direction;

switchable rotation-inducing means associated with the path and switchable between an inactive position and an active position in which a rotation of a sheet at a selected location along the path is induced; and sensing means operatively associated with the path and connected to the rotation-inducing means for sensing each sheet being transported along the path, recognizing at least one selected sheet format and switching the rotation-inducing means into its active position in response to recognition of the at least one selected format;

the sensing means including a plurality of sheet sensors disposed at respective locations along the path and spaced apart in the transporting direction with a separation corresponding to the at least one selected format;

the rotation-inducing means including a holder movable when the rotation-inducing means is in its active position into contact with a sheet at the selected location for causing that sheet to have a stationary axis of rotation perpendicular to the plane of the path, and control means for maintaining the rotation-inducing means in its active position for a time sufficient to enable a sheet contacted by the holder to undergo a rotation by 90°; and the sheet advancing means being constructed to permit slippage of a sheet at the selected location for permitting such rotation to occur.

Apparatus according to the invention provides a surprisingly simple opportunity for recognition of a specific sheet format on the sheet transportation path and for the rotation of the sheets by 90° such that the sheet enters the apparatus, e.g. for binding-edge perforation and for folding as needed, with the correct side of the sheet forward. To this end, the particular sheet is held at one point with the aid of the means provided by the invention and under the control of the sensors, such that it is caused to rotate about the holding point, because of the continuous action of the transporting means permitting the slippage admitted in accordance with the invention, until a rotation by 90° has taken place. This rotation can be adjusted in accordance with the advancing speed of the transporting means by adjusting the variable duration of the "on" state of the holder device.

According to a further possibility offered by the invention, transverse transporting means are set into motion during the "on" state of the holder device. These means place the sheet into rotation about the axis provided by the holder device. To this end, it is for example conceivable that the holder device may engage the center of the sheet and that, at the same time, rollers revolving in opposite directions and disposed respectively in front of and behind the holder device, as seen in the direction of advancement, may be caused to engage the sheet.

The same result can be attained by making the clamping force of the advancement means partially reinforceable for the pivoting movement. Thus correspondingly different advancement forces are exerted by the advancement means at different locations on the single sheet, in turn causing the pivoting of the sheet as a consequence of the resultant torque.

It has proved efficacious, however, for the holder device to be disposed with its axis of rotation at the outside, adjacent to the transporting means. As a result, because of the slippage permitted between the sheet and the transporting means, the rotation of the sheet is produced by the transporting means engaging it on the one hand and by the eccentricity of the axis of rotation on the other.

It is naturally understood that in all cases the holder device is disposed such that a particular sheet can be pivoted into the desired position, i.e., either it remains with its center on the same line of advancement as before, or the center is shifted to one side or the other.

It has further proved to be advantageous to dispose transverse transporting means on the feeder table in the transportation path over which the single sheets pass in the primary transporting direction. These transverse transporting means can be switched on and act upon the single sheets at right angles to the primary transporting direction. One sensor each is also disposed on the feeder table for switching the transverse transporting means on and off, and the sensors are actuatable by the single sheet being advanced at a particular time.

Because of these provisions, the possibility exists that when the first sensor is actuated, the sheets can be moved transversely to the previous direction of advancement until they arrive at a stop ridge and thus simultaneously at a second sensor which terminates the transverse movement. Further transportation is then again in the primary transporting direction. In this manner, single sheets of varying format can be uniformly oriented relative to the location provided for perforating the binding edges.

The holder device may have a sharpened point for perforating the single sheet being advanced, the tip being disposed coaxially with the axis of rotation provided by the holder device and being movable against a stop. When the holder device is in its "on" state, this produces a stationary center of rotation for the single sheet. It is efficacious to construct the holder device such that it is adjustable in the primary advancement direction, making it more easily adjustable to the most favorable axis of rotation.

However, the holder device may also have two clamping caps, or feet, protruding toward one another and located coaxially with the axis of rotation of the holder device. When the holder device is in its "on" state, these clamping caps clamp the sheets being advanced firmly between one another at a single point on the sheet and are rotatable about their common axis.

In all cases, the holder device may advantageously be electromagnetically actuatable, in which case then the duration of the "on" state can be determined in a finely-graduated way by means of an adjustable timing element.

The transverse transporting means already mentioned can have a driven stippler roller, movable against a counter-roller, at every location provided for acting upon the single sheet being advanced. When in the switched-on state, these rollers are pressed against one another and transport the sheet located between them.

Finally, the sensors for recognizing a sheet format can in a known manner be scanning pins connected with an electrical switch. Alternatively, they may, for example, be light barriers or the like.

DESCRIPTION OF THE PREFERRED EMBODIMENTS

Figure 1:
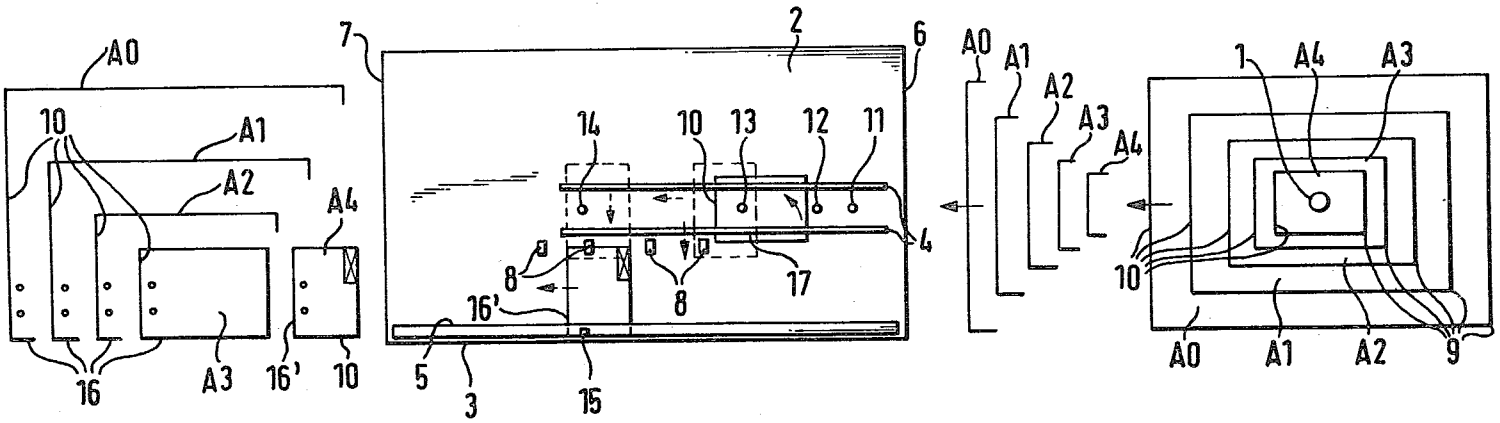
FIGS. 1–3 are schematic plan views of preferred embodiments of apparatus according to the invention.

At the right in FIG. 1, a known re-enlargement apparatus 1 which, by way of example, is programmable, is merely suggested. This apparatus automatically produces re-enlargements from microfilm on rectangular single sheets of standard formats A 0 through A 4 in numbers and sizes as required by the associated program and delivers these sheets continuously, one after the other, toward the left.

If it is intended that such single sheets should also be delivered continuously, in the same sequence, to another mechanical processor, such as for effecting a binding-edge perforation for collating purposes, reinforcing the perforated edge, and zig-zag folding in a suitable manner, then this purpose is served by the apparatus which is the subject of the invention for transporting the single sheets of different rectangular formats to the intended processing station. This transport apparatus is shown in the middle of FIG. 1 and includes a relatively long, flat feeder table 2 having a straight, upwardly projecting guide ridge 3 on one long edge, which ridge extends in the direction of advancement of the single sheets.

In the part of the table 2 which is midway between its longitudinal sides, two longitudinal transporting means 4 are disposed, parallel to the ridge 3, and spaced laterally apart from one another. Each has, for instance, an endless revolving conveyor belt the upper reach of which extends with its surface just above the surface of the table. Independently rotatably supported balls rest on this surface of the belt, at regular intervals from one another. The longitudinal transporting means may, however, be equally well composed of lower driven rollers protruding slightly above the table surface and upper rollers rotating on the lower rollers.

When a single sheet is transported, it arrives between the upper side of the belt and the balls resting thereon.

A third, similar, longitudinal transporting means 5 extends directly beside the guide ridge 3. While the entrance ends of these three transporting means 4 and 5 are located in the vicinity of the entrance edge 6 of the table 2, the transporting means 5 extends almost to the exit edge 7, while the transporting means 4 extends over only about two-thirds of the length of the table. It will be understood that the described transporting means all operate at the same advancement speed.

In the middle third of the length of the table, transverse transporting means 8 are provided between the longitudinal transporting means 4 and 5. These transverse means 8 each have, for example, two rollers disposed one above the other and cooperating at their peripheries. One of the rollers is fixedly mounted somewhat above the surface of the table, and the other roller is driven and is supported below the surface of the table such that it can be raised and lowered on a pivot arm. Thus the lower roller can operate as an actuatable stippler roller to press the single sheet to be transversely displaced against the periphery of the upper roller and transport it until the stippler roller is disengaged, i.e., until it is lowered again.

Each single sheet arriving on the table 2 from the re-enlargement apparatus has a workpiece list or plan designation at a uniform location at the lower right corner 9 of the sheet and has its left-hand narrow edge 10 leading. The leading narrow edge 10 of each sheet, which is thus the narrow edge more remote from the workpiece list or plan designation, is then in every instance engaged by the longitudinal transporting means 4. In the case of the larger sheet format A 0, the longitudinal transporting means 5 are also in its width range and also help to effect the transportation of the sheet.

In general, the single sheets of all formats A 0 through A 4 enter into the transporting means 4 with their longitudinal center axis at the middle of the table. Three light barriers 11, 12 and 13 are disposed spaced apart and one after the other between the transporting means 4 in the transporting direction, or in other words in the longitudinal direction of the table. These light barriers are intercepted one after the other by the single sheets being advanced, and are then unblocked again after the sheet format has been determined. In the present example, only the A 4 format triggers the operation to be described below.

If the forward edge 10 of the advancing single sheet interrupts a fourth light barrier 14 disposed near the exit end of the transporting means 4, then as a result of the electronic signal accordingly produced, the transverse transporting means 8 are switched on and displace the single sheet transverse to the previous transporting direction and against the guide ridge 3, until the sheet edge 16, which is the leading edge for this direction of movement, interrupts a fifth light barrier 15, disposed beside this ridge on the table, and then arrives at the ridge. The electronic signal caused by this interruption, which in the case of the A 0 format may as needed be provided directly upon the interruption of the light barrier 14, causes the switch-off of the transverse transporting means 8 at the same instant. Because of the characteristics of the longitudinal transporting means 4, they permit a certain slippage relative to a single sheet, permitting the sheet to be displaced transversely.

The longitudinal transporting means 5 displace the single sheet then along the ridge 3 toward the exit edge 7 of the table, where a mechanical processing procedure can begin—for instance, the perforation of the binding edge at the leading edge 10 of the sheet, at a correct distance from the longitudinal edge 16 of the sheet referred to above; this distance is assured by means of the transverse displacements of the single sheet at the guide ridge 3.

If, instead, a single sheet of A 4 format arrives with its narrow edge 10 at the middle of the longitudinal transporting means 4, then as it is transported longitudinally it interrupts first the first light barrier 11, and then the second light barrier 12 before interruption of the first light barrier ends. The A 4 sheet then ceases interrupting the first light barrier 11 before its front edge 10 interrupts the third light barrier 13. From this sequence it is recognized with the aid of simple electronic means known per se that what is taking place is the advancement of the narrow side of an A 4 sheet, and a switching enablement is provided for an electronic signal which is then initiated by the interruption of the third light barrier 13. This signal triggers the magnetic switching on of a holder device 17, which is attached to the feeder table 2 directly outside and alongside one of the longitudinal transporting means 4. When the holder device 17 is in the switched-on state, it holds the sheet in a manner to create an axis of rotation perpendicular to the plane of the table, at one eccentric point, for instance by means of a needle tip, so that the result is a center of rotation on the sheet.

The A 4 sheet is pivoted counterclockwise by 90° on the table, under the influence of the longitudinal transporting means 4 which allow a lateral slippage relative to the sheet that has already been mentioned, during a period, adjustable in accordance with the transporting speed, when the holder device is on. The holder device thereupon releases the single sheet and the sheet is then transported further in the longitudinal direction of the table, preferably again located centrally with respect to the longitudinal transporting means 4, with its long edge 16' remote from the workpiece list forwardmost.

When the A 4 sheet then interrupts the fourth light barrier 14, transporting means 8 are actuated to displace the sheet transversely, until its narrow edge 10 meets the guide ridge 3 and interrupts the light barrier 15. Further advancement along the ridge 3 takes the A 4 sheet into the intended mechanical processing at which, with the long edge 16' forwardmost, the perforation of the binding edge is effected in this forward edge as is desired for an A 4 format.

Figure 5:
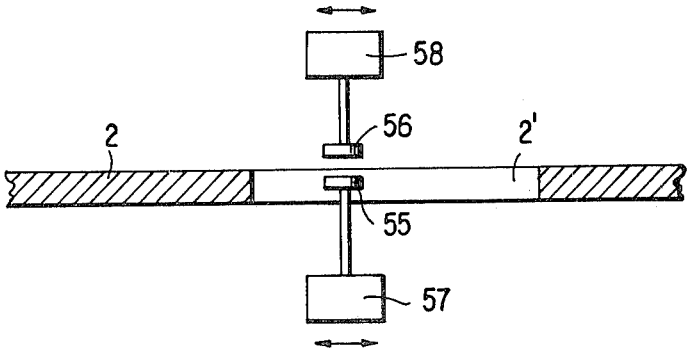
FIGS. 5 and 6 are elevational detail views, partly in cross section, of components of the apparatus of FIGS. 1–3.

Instead of a needle tip, the holder device may, as shown in FIG. 5, also have two clamping cups, or tips, 55 and 56 protruding toward one another. When the holder device is in its "on" state, these tips clamp the advancing sheet firmly between them and are rotatable, along with the sheet, about a common axis of rotation perpendicular to the plane of the table.

As further shown in FIG. 5, tips 55 and 56 are supported by electromagnetically actuated units 57 and 58 mounted to be adjustable in position in the transporting direction defined by the longitudinal transporting means 4 and 5. The holder device is here associated with a narrow slot 2' in table 2, slot 2' being provided to allow for adjustment of the position of units 57 and 58 in the direction of the arrows.

When single sheets of a format larger than A 4 are to be longitudinally transported, it should be noted that all three light barriers 11, 12 and 13 are interrupted simultaneously for a brief time; for this reason, no electronic signal for triggering the switching on of the holder device 17 occurs. By appropriate variation in the spacing of the light barriers disposed in sequence in the longitudinal transporting direction, it would be possible to enable the switching on of the holder device, and thus the rotation as well, for single sheets of a format different from A 4; one exemplary application will now be described.

Figure 2:
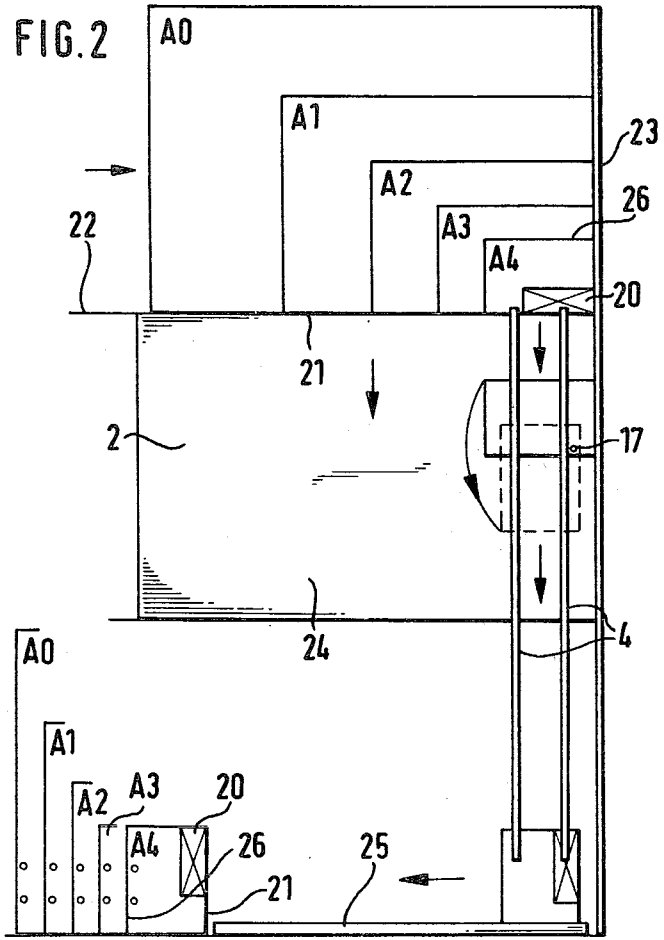

While in the exemplary embodiment shown in FIG. 1 the automatic re-enlargement apparatus 1 delivers all the resultant enlargements toward the left along their common longitudinal central line, a different automatic re-enlargement apparatus delivers the single sheets, of A 0 through A 4 format in the manner shown in FIG. 2. In this arrangement the long edge 21 of the sheet which adjoins the workpiece list is first shifted along a common base line 22 toward the right, up to a stop 23. However, the single sheets, which arrive in sequence at stop 23, must be delivered from the right to the apparatus depicted in FIG. 1 for effecting the perforation of the binding edge, with the sheet edge which is to be perforated being forwardmost. In order to make the necessary reversal of direction possible, in the present exemplary application the individual sheets are transported away by the previously described transporting apparatus on the plane of the feeder table 2, transversely relative to the base line 22, and fed to a transport track 24 having transporting means 25 which displaces the sheet parallel to the base line 22, but with the appropriate sheet edge forward and carried from right to left into the binding edge perforation apparatus.

The sheet of format A 4 is also engaged by the transporting means 4 with its long edge 21 forwardmost. However, the binding edge perforation must be effected at its other long edge 26. This necessitates a rotation of this sheet on the feeder table in a counterclockwise direction by 90°. This rotation is effected by mechanisms like those of FIG. 1, about the axis of rotation, perpendicular to the plane of the table, provided by the holder device 17 attached to the table and capable of being switched on. Once again, this device is switched on in response to the light barriers serving to recognize the sheet format.

In the present case, two light barriers could be sufficient, if they are disposed and switched such that after an interruption of the first light barrier in the advancement direction, this first barrier becomes uninterrupted once again before the second light barrier is interrupted, and that the holder device is then triggered by the interruption of the second light barrier.

Figure 3:
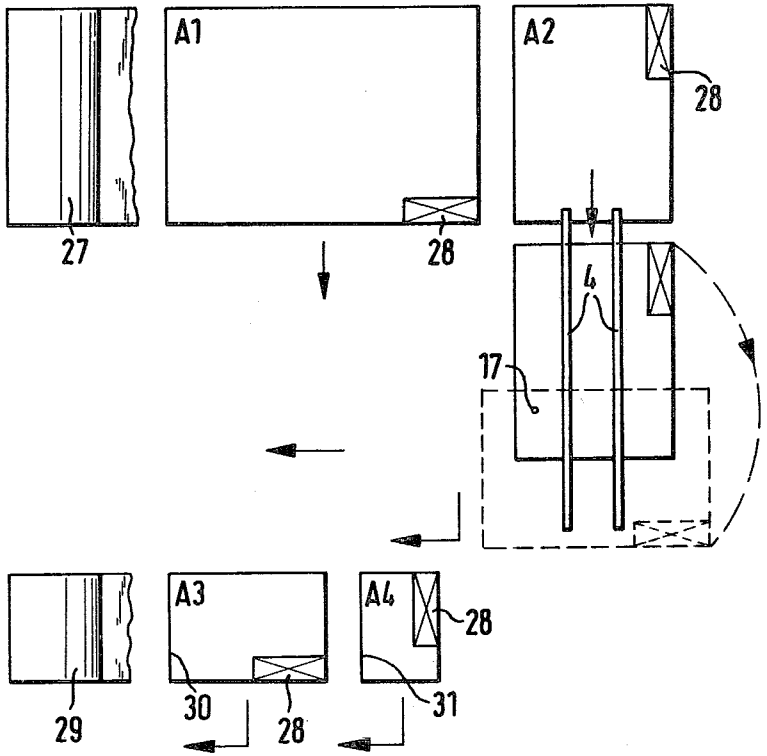

The necessity for rotating the single sheets may also arise, however, for other sheet formats. For instance, if an arrangement is provided, as shown in FIG. 3, in which sheets of two formats A 1 and A 2 are torn off from the same roll of paper 27 for re-enlargement purposes, then the width of the roll equals the narrow dimension of an A 1 sheet, and the long dimension of an A 2 sheet. Since the orientations of these two sheets with respect to their workpiece lists 28 are not in agreement, then the sheet of A 2 format must be rotated clockwise by 90° on the feeder table as it is transported along, this rotation being effected by the transporting means according to the invention. The light barriers for the recognition of an A 2 format and the actuatable holder device providing the axis of rotation must then be disposed in an appropriate manner so as to correspond to the A 2 format.

A roll of paper 29 can also be provided whose width equals the narrow dimension of an A 3 sheet and the long dimension of an A 4 sheet. When these two single sheets are separated from the roll 29, the sheet edges 30 and 31, respectively, which are intended for receiving the binding edge perforation are already in the correct orientations relative to their workpiece lists 28, so that these single sheets need only be displaced by translation when being transported as shown in FIG. 2.

It can be seen from FIGS. 1–3 that the holder device 17 is disposed with its axis of rotation outside and adjacent to the region enclosed by the longitudinal transporting means 4, so that both members of means 4 can act on the sheet in the same direction relative to the axis of rotation of the sheet, thus effecting the rotation of the sheet.

However, it is also possible to provide the holder device at some other location, for instance at the center of the sheet which is to be pivoted. In that case, the pivoting of the sheet can be effected by two means similar to the transverse transporting means and driven in respectively opposite directions. It is alternatively possible, for instance, to adjust the slippage at the two members of transporting means 4 such that the slippages are momentarily different, so that the force exerted on one side of the axis of rotation is increased relative to that exerted on the other side.

Figure 4:
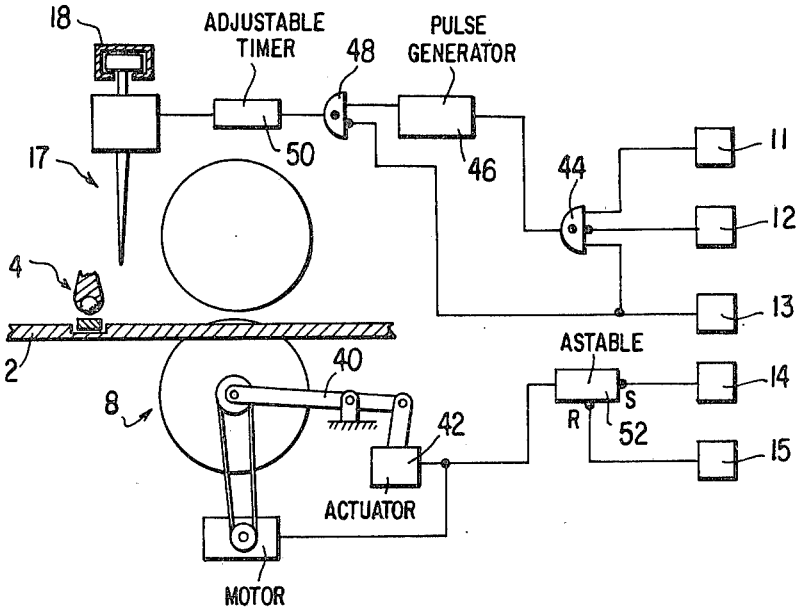
FIG. 4 is a partly cross-sectional, partly schematic view of the basic mechanical and circuit components of the transporting system according to one embodiment of the invention.

The essential elements of one suitable embodiment of a sheet transporting system according to the invention are illustrated in FIG. 4 which shows, in cross section, a portion of table 2 presenting a horizontal transporting path. The table top includes recesses, one of which is shown in the Figure, for receiving the upper reach of a belt constituting one of the longitudinal transporting members 4. Above the belt, there is disposed a fixed guide supporting the roll balls which are freely rotatable and can rest upon the upper reach of the belt, while having a certain amount of vertical play to permit passage of a flexible sheet between the belt and the balls. Alongside the illustrated transporting member 4 there is disposed a holder device 17 which includes a pointed needle supported by an electrically actuatable magnetic unit which, upon being actuated, will displace the needle downwardly to puncture an underlying flexible sheet. Holder device 17 is supported in a channel 18 to be adjustable in position in the transporting direction defined by the longitudinal transporting means 4 and 5. Also shown is one pair of rollers of the transverse transporting means 8. The lower roller, which can be a stipple roller, is mounted on a pivot arm 40 which is pivotal about a fixed axis under the influence of an electrically actuatable electromagnetic actuator 42 which can be constituted by a solenoid associated with a plunger articulated to one end of arm 40. The lower roller is arranged to be driven by a motor through a suitable drive belt.

The sensors 11, 12, and 13 have their outputs connected to a first AND gate 44, sensors 11 and 13 being directly connected to inputs of that gate and sensor 12 being connected to an inverting input thereof. The output of gate 44 is connected to a pulse generator 46 which produces an output pulse of selected duration in response to each output signal provided by gate 44. The output of pulse generator 46 is connected to a direct input of a further AND gate 48 which also has a negated input connected to the output of sensor 13. The output of gate 48 is connected to an adjustable timer 50 which responds to each output signal from gate 48 to produce an output signal of adjustable duration to actuate device 17, i.e. to displace the needle associated with that device downwardly into engagement with an underlying flexible sheet. As would be appreciated, gate 44 will produce an output signal only when the light path associated with sensor 12 is interrupted at a moment when the light paths of both sensors 11 and 13 are uninterrupted, which can occur only during the passage of an A 4 sheet. The resulting output signal from gate 44 actuates generator 46 to cause it to produce an output pulse of suitable duration. When, thereafter, the light path associated with sensor 13 is interrupted, gate 48 produces an output signal which actuates adjustable timer 50 to displace the needle of holder 17 downwardly for a period of time selected to assure that the sheet penetrated by the needle will undergo a rotation through an angle of 90° under the influence of the longitudinal displacement forces produced by transporting means 4. At the end of this time period, the needle is retracted and the sheet is permitted to continue its advance in the longitudinal direction.

The sheet then continues its advance until it interrupts the light path associated with sensor 14, at which time a bistable device 52 having a negated set input S connected to the sensor is actuated to produce an output signal. This output signal activates actuator 42 in order to pivot the lower roller of the transverse transporting means upwardly toward its associated counter-roller, and also actuates the motor to set the lower roller into rotation. The sheet is then transported transversely until it reaches the position at which the light path associated with sensor 15 is interrupted. This terminates the output signal from sensor 15. The output of sensor 15 is also connected to a negated reset input R of the bistable device 52 so that when the light path associated with sensor 15 is interrupted, the bistable device is reset to its starting, or off, state and actuator 42 and the motor are deactuated. Preferably, bistable device 52 has a pulse edge controlled set input S and a signal level controlled reset input R. This means that the device will be set by a negative-going edge of the signal from sensor 14 but will be reset whenever the light path of sensor 15 is blocked. This assures that device will be properly reset if the light paths of both sensors 14 and 15 are simultaneously interrupted, as by an A 0 sheet, or if the light path of sensor 14 remains interrupted even after that of sensor 15 has been interrupted, which would occur in the case of an A 1 sheet.

Further details of the switching of the holder device need not be given here. Depending on circumstances, what is essential is only that the switching means include a timing element for the "on" state duration of the holder device, this duration being efficaciously adjustable, and that if needed, an adjustable time-delay element is provided to determine the time interval between the pulse for switching on the holder device and the actual process of switching on the holder device.

In terms of the sensors or light barriers, the arrangement described above is always such that these elements are disposed one after the other in the primary advancement direction and are adjustable in position as needed.

Figure 6:
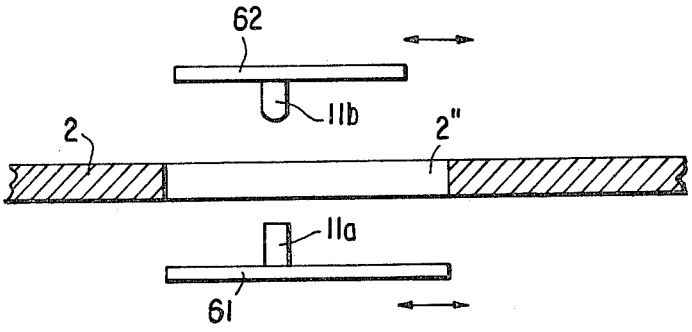

One suitable arrangement for this purpose is shown in FIG. 6 with respect to sensor 11 in the form of a light barrier composed of a light source 11*a* mounted on a carrier 61 and a light receiver 11*b* mounted on a carrier 62. Carriers 61 and 62 are movable together, as indicated by the arrows, in the transporting direction defined by the longitudinal transporting means 4 and 5. Communication between source 11*a* and receiver 11*b* is assured by the provision of a narrow slot 2″ in table 2, the length of slot 2″ corresponding to the intended position adjustment range of the light barrier. However, depending on given conditions, cases are also possible and conceivable where it may be useful to dispose the sensors transversely across the primary advancement direction, beside one another. In the case of the embodiment of FIG. 2, for instance, this could be done by disposing one sensor, relating to the A 4 sheet being advanced to the position of device 17, on the right-hand side, approximately at the level of the holder device 17, while a second sensor is disposed on the left-hand side of the advancement means 4, located further upward with respect to the plane of FIG. 2 and outside the borders of the indicated A 4 sheet format yet such that it is located inside the A 3 format. Now if the A 4 sheet is transported forward, and the last-mentioned sensor is not encountered at the time the sensor disposed at 17 is encountered, then the actuation of the holder device can be triggered accordingly. This is not the case for the other sheet formats, because the first sensor in the advancement direction, i.e. the sensor to the left of the advancement means 4, will have already been encountered at the time when the sensor at 17 i.e. to the right of the advancement means, is later encountered.

In order to secure the rotation angle of the desired sheets, for example those of A 4 format at 90° in accordance with the transporting speed, there is shown in FIG. 4 an adjustable time giving element known per se for the holding period of the holder device 17.

It will be understood that the above description of the present invention is susceptible to various modifications, changes and adaptations, and the same are intended to be comprehended within the meaning and range of equivalents of the appended claims.

What is claimed is:

1. Apparatus for transporting single flexible sheets having different rectangular formats in succession to an automatic device for further processing, said apparatus comprising:

means defining a flat sheet-advancement path for transporting the sheets in a transporting direction to the automatic device;

sheet advancing means associated with said path for advancing each sheet in a straight line on said path in the transporting direction;

switchable rotation-inducing means associated with said path and switchable between an inactive position and an active position in which a rotation of a sheet at a selected location along the path is induced; and sensing means operatively associated with said path and connected to said rotation-inducing means for sensing each sheet being transported along said path, recognizing at least one selected sheet format and switching said rotation-inducing means into its active position in response to recognition of the at least one selected format;

said sensing means comprising a plurality of sheet sensors disposed at respective locations along said path and spaced apart in the transporting direction with a separation corresponding to the at least one selected format;

said rotation-inducing means comprising a holder movable when said rotation-inducing means is in its active position into contact with a sheet at the selected location for causing that sheet to have a stationary axis of rotation perpendicular to the plane of said path, and control means for maintaining said rotation-inducing means in its active position for a time sufficient to enable a sheet contacted by said holder to undergo a rotation by 90°; and said sheet advancing means being constructed to permit slippage of a sheet at the selected location for permitting such rotation to occur.

2. Apparatus as defined in claim 1 wherein said holder is disposed to provide the axis of rotation at a location outside of, and laterally adjacent to said advancing means.

3. Apparatus as defined in claim 2 wherein said holder has a needle tip movable against a stop, for perforating a sheet at the selected location, said tip being coaxial with the axis of rotation created by said holder.

4. Apparatus as defined in claim 2 wherein said holder comprises two sheet-contacting elements coaxial with the axis of rotation, said elements protruding toward one another and being relatively movable to firmly clamp a sheet between them in the active position of said transverse displacement means, at a single point on the sheet, and said elements being rotatable about the axis of rotation.

5. Apparatus as defined in one of the claims 1, 2, 3 or 4 wherein said holder device is adjustable in position in the transporting direction.

6. Apparatus as defined in claim 1 further comprising: switchable transverse sheet displacement means associated with said path and switchable into an active position for displacing a sheet advancing over said path in a direction perpendicular to the transporting direction; and further sensing means operatively associated with said path and connected to said transverse displacement means for sensing a sheet in the region of said transverse displacement means and controlling the switching of said transverse displacement means.

7. Apparatus as defined in claim 6 wherein said transverse displacement means comprise at least one stipple roller and at least one counter roller aligned with said stipple roller, and said further sensing means are connected for switching said transverse displacement means into its active position by moving said rollers toward one another and placing said rollers into rotation.

8. Apparatus as defined in claim 1 wherein said sheet sensors are light barriers.

9. Apparatus as defined in claim 1 wherein said sheet sensors are adjustable in position in the transporting direction.

10. Apparatus as defined in claim 1 wherein said control means cooperate with said sheet sensors and comprise an adjustable timing element for controlling the length of time during which said sheet sensing means is in its active position.

11. Apparatus as defined in claim 10 wherein said control means further comprise an adjustable time-delay element for triggering the switching of said rotation-inducing means into its active position.

12. Apparatus as defined in claim 1 wherein said sheet sensors are disposed one after the other in the transporting direction.

* * * * *